US011603724B1

(12) United States Patent
Bell et al.

(10) Patent No.: US 11,603,724 B1
(45) Date of Patent: Mar. 14, 2023

(54) MUD FLOW MEASUREMENT SYSTEM FOR WELLHEADS

(71) Applicants: Joel David Bell, Katy, TX (US); Zaki Din Husain, Katy, TX (US)

(72) Inventors: Joel David Bell, Katy, TX (US); Zaki Din Husain, Katy, TX (US)

(73) Assignee: Bell Technologies, LLC, Katy, TX (US)

( * ) Notice: Subject to any disclaimer, the term of this patent is extended or adjusted under 35 U.S.C. 154(b) by 0 days.

(21) Appl. No.: 17/403,249

(22) Filed: Aug. 16, 2021

(51) Int. Cl.
*E21B 21/08* (2006.01)

(52) U.S. Cl.
CPC ..... *E21B 21/08* (2013.01)

(58) Field of Classification Search
CPC ..... E21B 21/08
See application file for complete search history.

(56) References Cited

U.S. PATENT DOCUMENTS

| | | | | |
|---|---|---|---|---|
| 4,274,283 | A * | 6/1981 | Maus | E21B 21/08 73/152.52 |
| 7,357,040 | B2 | 4/2008 | Bell | |
| 9,291,486 | B2 | 3/2016 | Singfield | |
| 10,054,472 | B1 | 8/2018 | Bell | |
| 10,444,044 | B2 | 10/2019 | Bell et al. | |
| 10,794,741 | B2 | 10/2020 | Bell et al. | |
| 2007/0034018 | A1* | 2/2007 | Bell | G01F 1/42 73/861.63 |
| 2017/0211345 | A1* | 7/2017 | Lien | E21B 21/065 |
| 2018/0045001 | A1* | 2/2018 | Johnson | E21B 17/07 |
| 2018/0187498 | A1* | 7/2018 | Sanchez Soto | E21B 21/08 |
| 2019/0145198 | A1* | 5/2019 | Fossli | E21B 21/001 166/335 |

* cited by examiner

*Primary Examiner* — Brad Harcourt
(74) *Attorney, Agent, or Firm* — Shawn Hunter

(57) ABSTRACT

A mud flow measurement apparatus is described which is capable of measuring mud flow rate and density at or near the wellhead during a drilling operation. A riser assembly includes a torus wedge meter and density detection elements which are interconnected with a flow computer. Flow parameters are measured for unscreened drilling mud exiting a wellbore.

10 Claims, 3 Drawing Sheets

MUD FLOW MEASUREMENT SYSTEM FOR WELLHEADS

BACKGROUND OF THE INVENTION

1. Field of the Invention

The invention relates generally to devices and methods for measuring the volume and/or flow rate and density of drilling mud from a wellhead.

2. Description of the Related Art

During drilling of a hydrocarbon production wellbore drilling mud is used to lubricate the bit and remove cuttings from the well bottom. Drilling mud typically consists of a mixture of water and/or oil with insoluble solids, salts, minerals and other additives. During drilling, drilling mud is flowed down the drilling string and returned up through the annulus along with drill cuttings. Upon leaving the wellbore, the mud flows into one or more shakers and/or screens for removal of cuttings and heavy debris and ultimately to a mud pit wherein it is stored for re-use. The density and flow rate of the screened mud is often measured as it moves through the system so that changes can be made to the composition of the mud.

The flow of mud leaving the wellbore can fluctuate greatly as a result of mud flow system kicks. Kicks are caused by unintended flow of formation fluids into a wellbore. These are characterized by a significant increase in pressure differential which is followed by pressure drop. The flow rates following the pressure drop can be so low that they are difficult to measure with any accuracy using conventional technology. Early kick detection is an important focus for preventing "loss of well control" events which could lead to an uncontrolled flow of formation fluids from a wellhead.

U.S. Pat. No. 9,291,486 ("Method and System for Measuring Fluid Flow in Bell Nipples Using Pressure Measurement") issued to Singfield describes a system wherein drilling mud flow is measured using pressure transducers within the annulus proximate the wellhead. Flow rate is inferred from the detected pressure. Density of the drilling mud is determined separately by siphoning off a fraction of the mud being supplied to the wellbore and measuring the density of this siphoned portion with a Coriolis meter. This system is not effective for measuring the density of unscreened drilling mud exiting the wellbore. Notably, measurement systems such as this determine the density of a flow of screened mud and not the density of mud exiting the wellbore which contains cuttings and other solids. All measurements (density, pressure, flow rate) of the mud are of either mud which is being supplied to the wellbore or which has exited the wellbore and then been passed through shakers and screens to remove cuttings and other debris. Therefore, these measurements have limited value in early kick detection.

SUMMARY OF THE INVENTION

The invention provides a system for measurement of flow rate and density of a drilling mud flow exiting a wellbore. In preferred embodiments, flow rate and density are measured at the wellhead itself. A mud measurement system is described which determines both mud flow rate and mud density at or near the wellhead. Locations which are at or near the wellhead are considered to be locations between the exit of the wellbore and before screening or filtering of cuttings and other solids from the drilling mud. Preferably also, locations at or near the wellbore are locations after the exit of the wellbore which are before any portion of drilling mud is diverted from the main flow.

Direct mud flow measurement at or near the exit of the wellbore allows better detection of potentially dangerous upcoming kicks in the drilling system which will permit operators to take action to avoid said possible kick. Sharp increases or fluctuations in flow rate or volume or other early kick predictors can be detected in this mud flow which might not be easily measured or timely measured by flow meters or other devices which measure mud flow rate or volume after the drilling mud has passed through shakers or screens, such as mud pit volume totalizers. Additionally, described embodiments of the invention permit detection of very low flow rates indicative of a pressure drop following a significant increase in pressure differential.

In a described embodiment, detection components of the mud measurement system are incorporated into a riser assembly which is secured to the wellhead. The riser assembly includes a riser and a torus wedge flowmeter. The torus wedge flowmeter is used to detect flow rate for mud leaving the wellbore. Density of drilling mud exiting the wellbore is detected using high and low pressure diaphragm seals on the riser with associated high range and low range differential pressure transmitters. The diaphragm seals may include various known types of pressure sensors/transducers whose pressure sensing capability does not deteriorate over time due to deposits of solids from the returning mud with cuttings in the pressure sensing ports. Herein, however, the pressure sensor at each pressure port is referred to simply as a diaphragm seal pressure sensor or diaphragm seal.

Mud flow rate and density are determined by an associated flow computer which is operably associated with the torus wedge flowmeter as well as the high and low range pressure transmitters of the riser. The flow computer is a programmable logic controller which is programmed to calculate flow rates from upstream and downstream pressure transducers or taps associated with the torus wedge meter. In addition, the flow computer can determine density based upon readings provided from the diaphragm seals.

The torus wedge flowmeter is preferably adapted to detect both a high and a low range of flow rate. In a described embodiment, a first pair of pressure seals is configured to detect low flow rates which are rates of flow below a predetermined level. A second pair of pressure seals is configured to detect high flow rates which are above a predetermined level. This configuration allows for accurate measurement of flow rates during and following a mud system kick. The density detection arrangement preferably also allows for measurement of both high and low density ranges.

The invention provides systems and methods for measuring parameters of flows of unscreened, unfiltered drilling mud which contains cuttings and other solids and materials which have entered the drilling mud within the wellbore.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
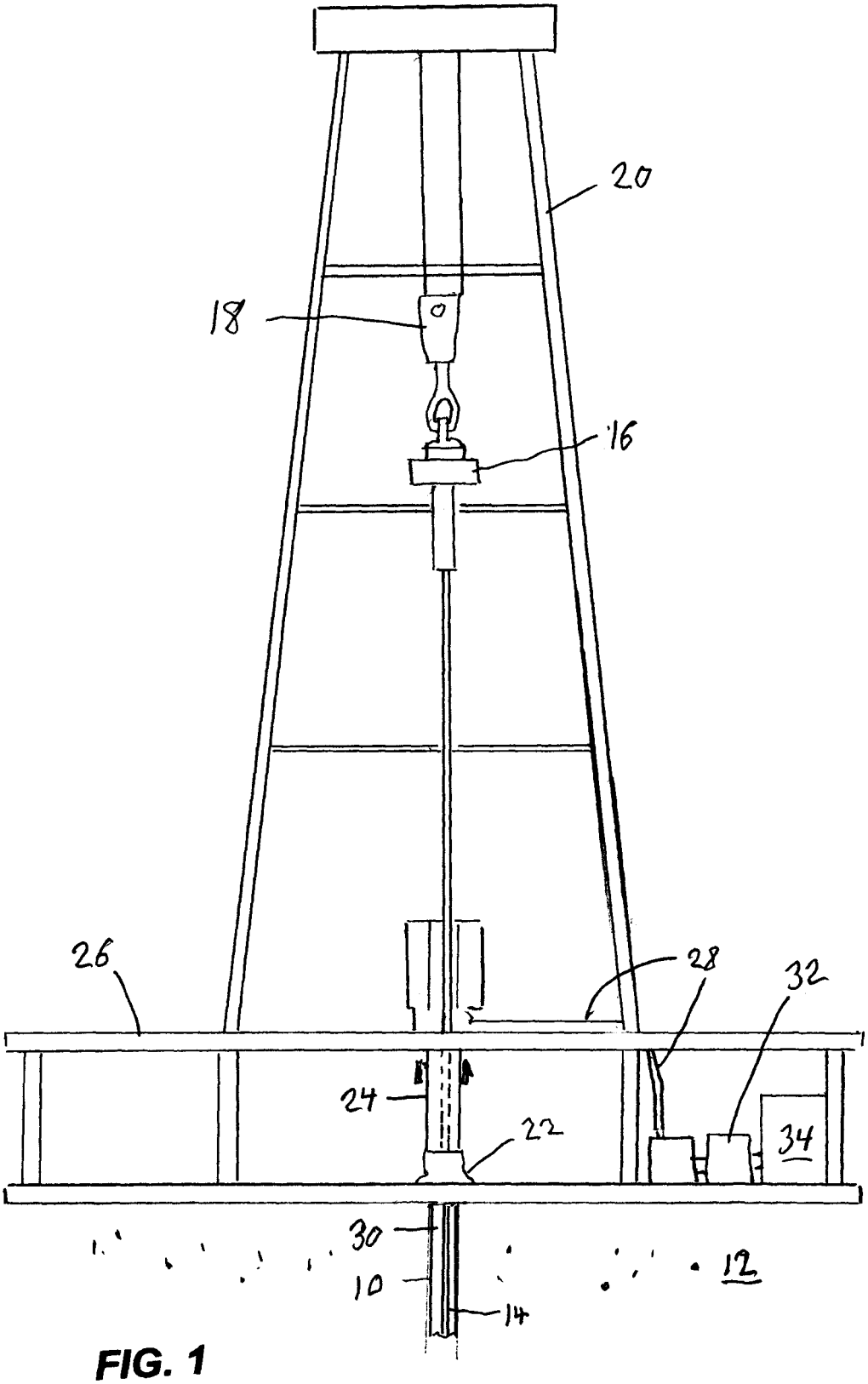
FIG. 1 is a schematic view of an exemplary wellbore drilling arrangement which incorporates a mud measurement system in accordance with the present invention.

FIG. 1 depicts an exemplary drilling arrangement in which a wellbore 10 is being drilled into the earth 12 using a drill string 14 and top drive 16 which are suspended by a traveling block 18 from a derrick 20 in a manner known in the art. A wellhead 22 defines the opening of the wellbore. The wellhead 22 is typically topped with one or more blowout preventers (not shown). A riser assembly 24 extends upwardly from the wellhead 22 to upper decking 26. At the upper decking 26 a diverter line 28 communicates drilling mud exiting the annulus 30 of the wellbore 10 to shakers 32 and mud pit 34. The terms "unscreened drilling mud" or "unscreened mud" as used herein will refer to drilling mud which has exited a wellbore and which has not passed through any shakers or screens to remove drill cuttings or other solids.

Figure 2:
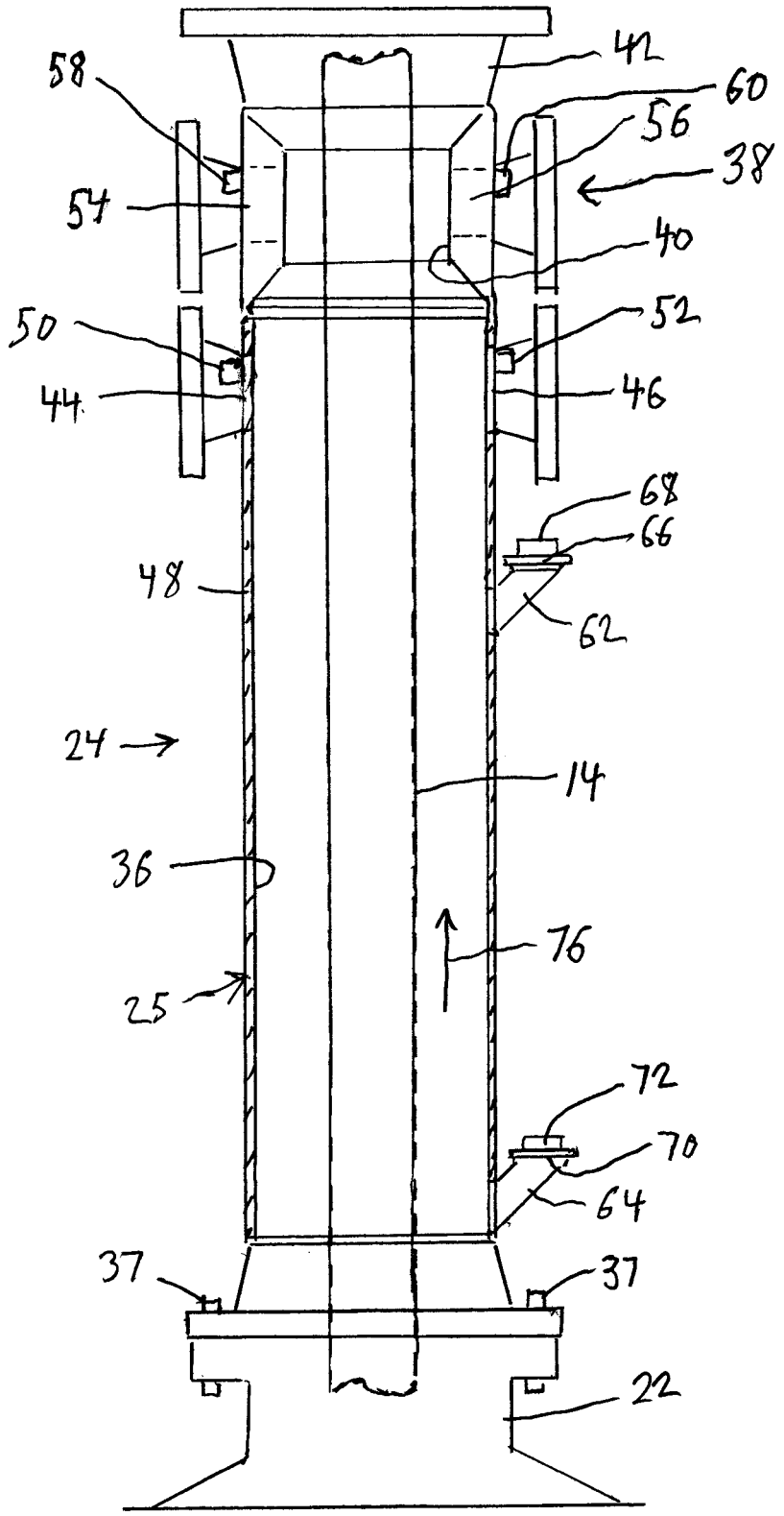
FIG. 2 is a side, cross-sectional view of portions of the wellhead which incorporate elements of the mud measurement system.

FIG. 2 is a side, cross-sectional view of an exemplary riser assembly 24 which is constructed in accordance with the present invention. A bore 36 is defined within the riser assembly 24, and the drill string 14 is shown disposed within the bore 36. The riser assembly 24 may be affixed to the wellhead 22 using bolts or other connectors 37.

A torus wedge meter 38 is mounted to the upper end of the riser 25 of the riser assembly 24. The torus wedge meter 38 in general operates using principles described in U.S. Pat. Nos. 7,357,040 ("Torus Wedge Flow Meter"), 10,444,044 ("Flow Measurement Systems and Methods") or 10,054,472 ("Fluid Flow Meter"). Each of these patents are owned by the applicant and are herein incorporated by reference in their entirety. In general, the torus wedge meter 38 presents a flow restriction 40 which creates a pressure drop for fluid passing through the torus wedge meter 38. Measurement of fluid pressure upstream of the flow restriction 40 is compared to measurement of pressure either downstream or at the flow restriction 40 which will allow flow rate to be calculated. An outlet flange 42 is secured to the upper end of the torus wedge meter 38 and leads upwardly toward the upper decking 26 and mud diversion line 28 which will take exhausted mud to debris screens and shakers 32 and to mud pit 34.

Upstream lateral openings 44 and 46 are disposed through the riser body 48. The upstream lateral openings 44, 46 are provided with pressure transducers or taps 50, 52 respectively which are capable of measuring the fluid pressure of drilling mud entering the torus wedge meter 38. Downstream lateral openings 54, 56 are disposed through the body of the torus wedge meter 38 and are also provided with pressure transducers, 58, 60 respectively, which are capable of measuring the fluid pressure of drilling mud passing through the flow restriction 40.

In preferred embodiments, the mud measurement system of the present invention includes a mechanism for detecting and measuring the density of unscreened drilling mud which is flowing from the wellbore 10. Flow conduits 62, 64 are in fluid communication with the bore 36 of the riser assembly 24. Flow conduit 62 is provided with a low-pressure diaphragm seal 66 and low-pressure transmitter 68. Flow conduit 64 is provided with a high-pressure diaphragm seal 70 and high-pressure transmitter 72. The differential pressure transmitters 68, 72 detect fluid pressure and are used for measurement of density of drilling mud returning uphole and emerging from the wellhead.

Figure 3:
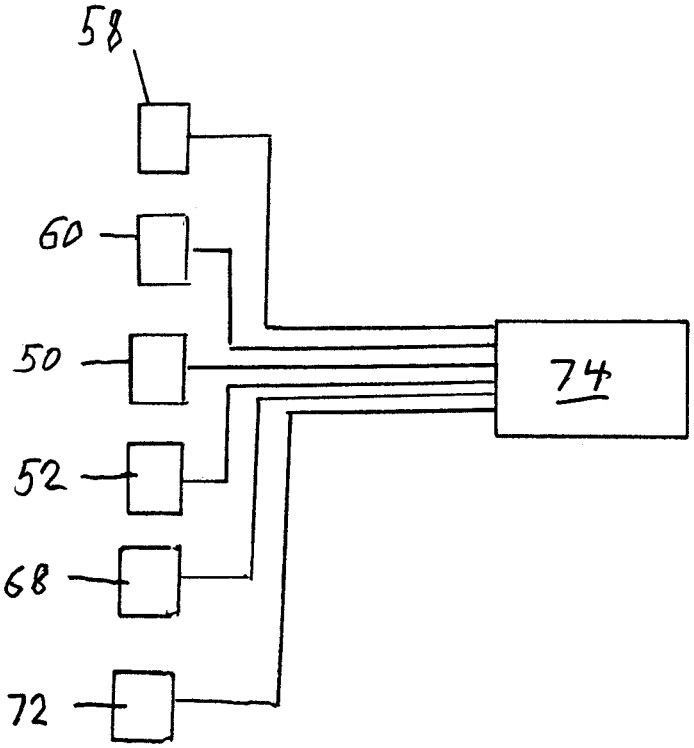
FIG. 3 is a schematic view of electrical elements of the present invention.

A flow computer 74 is shown in FIG. 3. The flow computer 74 is a programmable logic controller which is programmed to conduct calculations to determine pressure differentials based upon measured pressures. As illustrated by FIG. 3, the flow computer 74 is operably connected using wired or wireless connection to pressure taps 50, 52, 58 and 60 for flow rate determination as well as pressure transmitters 68, 72 for determination of drilling mud density.

In operation during a drilling operation, drilling mud flows upwardly from the annulus 30 into the bore 36 of the riser assembly 34 as illustrated by arrow 76 in FIG. 2. Mud will flow into the flow conduits 62, 64 and contact the diaphragms 66, 70 to provide an indication of mud density (i.e., weight-loaded measured density). Differential pressure transmitters 68, 72 provide this information to the flow computer 74 from which density of the drilling mud is determined.

The torus wedge meter 38 is preferably adapted to measure both high and low ranges of fluid pressure. By establishing two ranges of flow rates for measurement, the system will be able to measure rates more accurately. Via flow computer programming, the upstream pressure tap 50 and downstream pressure tap 58 are adapted as a pair to measure a lower range of pressures, 0-200 psi, for example. While the pair of upstream tap 52 and downstream tap 60 is adapted to measure a higher range of pressures, such as from 200 psi upward. Preferably, flow alarm limits are programmed into the flow computer 74 so that operators can be alerted to flow rates which exceed expected limits. Too high a flow rate might indicate a mud kick while a very low flow rate might also be indicative of a kick which has just occurred.

Similarly, the flow computer 74 preferably uses dual ranges of measurement for density. The diaphragm seal 66 is tuned to detect lower range of density while diaphragm seal 70 is adapted to detect a higher range of density. The upper and lower ranges are preferably separated by a predetermined measurement point. For example, the diaphragm seal 66 might measure flow densities which are 10 $kg/m^3$ or below while the diaphragm seal 70 measures flow densities which are above 10 $kg/m^3$.

It is noted that the measurement devices (wedge meter 38, diaphragm seals 66, 70) may be placed at other locations within the drilling mud flow system between the annulus 30 of the wellbore 10 and the shakers 32. They might be placed, for example, above the upper decking 26 so long as the parameters of the exiting drilling mud are measured before solids are screened or remove from the mud.

What is claimed is:

1. A system for measurement of drilling mud flow parameters of unscreened drilling mud exiting a wellbore comprising:

- a torus wedge meter operable to detect the flow rate of unscreened drilling mud passing through the torus wedge meter upon exiting the wellbore;
- a flow computer operably interconnected with the torus wedge meter for determination of flow rate;
- a first diaphragm seal is associated with the riser for detection of a density for unscreened drilling mud in a range below a predetermined measurement point; and a second diaphragm seal is associated with the riser for detection of a density for unscreened drilling mud in a range above the predetermined measurement point.

2. The system of claim 1 wherein the torus wedge meter is incorporated into a riser assembly which is operably associated with the wellbore to receive the unscreened drilling mud which exits the wellbore.

3. The system of claim 2 further comprising:

a density measurement diaphragm seal associated with the riser assembly to detect density of the unscreened drilling mud;

a differential pressure transmitter operably associated with the diaphragm seal; and the diaphragm seal and differential pressure transmitter detecting a density for the drilling mud flowing within the bore.

4. The system of claim 1 wherein the torus wedge meter is adapted to separately detect a low flow rate, which is a flow rate below a predetermined flow rate level, and a high flow rate, which is above the predetermined flow rate level, for unscreened drilling mud.

5. A mud flow measurement apparatus for use with a wellhead, comprising:

a riser assembly for operable association with the wellhead, the riser assembly having a bore for flow of unscreened drilling mud exiting the wellhead;

a torus wedge meter within the riser assembly for detection of a differential pressure in unscreened drilling mud flowing within the bore;

a first diaphragm seal is associated with the riser for detection of a density for unscreened drilling mud in a range below a predetermined measurement point; and a second diaphragm seal is associated with the riser for detection of a density for unscreened drilling mud in a range above the predetermined measurement point.

6. The mud flow measurement apparatus of claim 5 further comprising a flow computer operably interconnected with the torus wedge meter for receipt of a signal from the torus wedge meter indicative of the detected differential pressure and to determine a flow rate from the detected differential pressure.

7. The mud flow measurement apparatus of claim 5 further comprising:

a density measurement diaphragm seal associated with the riser to detect density of the unscreened drilling mud;

a differential pressure transmitter operably associated with the diaphragm seal to provide a signal indicative of the density to the flow computer; and the diaphragm seal and differential pressure transmitter detecting a density for the drilling mud flowing within the bore.

8. The mud flow measurement apparatus of claim 5 wherein the torus wedge meter is adapted to separately detect a low flow rate and a high flow rate for unscreened drilling mud.

9. A method of measuring flow parameters for unscreened drilling mud exiting a wellbore, the method comprising:

flowing the unscreened drilling mud through a torus wedge meter;

detecting a flow rate for the unscreened drilling mud with the torus wedge meter;

detecting a density of the unscreened mud with:

a first diaphragm seal which detects density in a range below a predetermined point, and a second diaphragm seal which detects density in a range above the predetermined point.

10. The method of claim 9 wherein density of the unscreened drilling mud is detected by:

flowing the unscreened drilling mud through a riser assembly which is attached to the wellhead; and detecting loading on said first and second diaphragm seals associated with the riser assembly to measure density.

* * * * *